US011203840B2

(12) United States Patent
Rodden

(10) Patent No.: US 11,203,840 B2
(45) Date of Patent: Dec. 21, 2021

(54) METHOD AND APPARATUS FOR TWO-LIFT CONCRETE FLATWORK PLACEMENT

(71) Applicant: Illinois Tool Works Inc., Glenview, IL (US)

(72) Inventor: Robert Alan Rodden, Atlanta, GA (US)

(73) Assignee: Illinois Tool Works Inc., Glenview, IL (US)

( * ) Notice: Subject to any disclaimer, the term of this patent is extended or adjusted under 35 U.S.C. 154(b) by 33 days.

(21) Appl. No.: 16/907,539

(22) Filed: Jun. 22, 2020

(65) Prior Publication Data

US 2020/0407924 A1 Dec. 31, 2020

Related U.S. Application Data

(60) Provisional application No. 62/866,331, filed on Jun. 25, 2019.

(51) Int. Cl.

| | |
|---|---|
| ***E01C 11/00*** | (2006.01) |
| ***E01C 11/06*** | (2006.01) |
| ***E01C 11/14*** | (2006.01) |
| ***E01C 7/14*** | (2006.01) |

(52) U.S. Cl.
CPC ..... *E01C 11/06* (2013.01); *E01C 7/14* (2013.01); *E01C 11/14* (2013.01)

(58) Field of Classification Search
CPC ..... E01C 7/14; E01C 11/06; E01C 11/14
USPC ..... 404/17, 28–31, 56, 57, 72, 75
See application file for complete search history.

(56) References Cited

U.S. PATENT DOCUMENTS

| | | | |
|---|---|---|---|
| 1,436,896 | A | 11/1922 | Newell |
| 1,863,115 | A | 6/1932 | Heltzel |
| 1,942,494 | A | 1/1934 | Robertson |
| 1,991,931 | A | 2/1935 | Kling et al. |
| 2,093,697 | A | 9/1937 | Scholer |
| 2,164,590 | A | 7/1939 | Oates |
| 2,192,571 | A | 3/1940 | Bitney |
| 2,319,050 | A | 5/1943 | Fischer et al. |
| 2,575,247 | A | 11/1951 | Carter |

(Continued)

FOREIGN PATENT DOCUMENTS

| | | |
|---|---|---|
| DE | 843706 | 11/1952 |
| DE | 19544587 | 6/1997 |

(Continued)

OTHER PUBLICATIONS

International Search Report and Written Opinion for International Application No. PCT/US2020/039066, dated Oct. 2, 2020 (11 pages).

(Continued)

*Primary Examiner* — Raymond W Addie
(74) *Attorney, Agent, or Firm* — Neal, Gerber & Eisenberg LLP

(57) ABSTRACT

A method of manufacturing a concrete substrate includes placing a first concrete layer on a support base configured to support the concrete substrate, positioning a concrete slab load transfer apparatus on a top surface of the first concrete layer, wherein the top surface of the first concrete layer supports the concrete slab load transfer apparatus, and placing a second concrete layer on the top surface of the first concrete layer such that the second concrete layer covers the concrete slab load apparatus.

18 Claims, 8 Drawing Sheets

(56) References Cited

U.S. PATENT DOCUMENTS

| | | | | |
|---|---|---|---|---|
| 2,627,793 | A | 2/1953 | White | |
| 2,634,660 | A | 4/1953 | Godwin | |
| 2,783,695 | A | 3/1957 | De Canio | |
| 2,858,748 | A | 11/1958 | Crone | |
| 2,864,289 | A | 12/1958 | De Canio | |
| 3,022,713 | A | 2/1962 | Friberg | |
| 3,033,087 | A | 5/1962 | Bror | |
| 3,059,553 | A | 10/1962 | Woolley | |
| 3,104,600 | A | 9/1963 | White | |
| 3,260,177 | A * | 7/1966 | Hudis | E01C 19/407 404/100 |
| 3,279,335 | A | 10/1966 | Garner | |
| 3,397,626 | A | 8/1968 | Kornick et al. | |
| 3,437,017 | A | 4/1969 | Walz | |
| 3,702,093 | A | 11/1972 | Van de Loock | |
| 4,653,956 | A | 3/1987 | Lang | |
| 5,366,319 | A | 11/1994 | Hu | |
| 6,019,546 | A | 2/2000 | Ruiz | |
| 6,052,964 | A | 4/2000 | Ferm | |
| 6,092,960 | A | 7/2000 | Mccallion | |
| 6,210,070 | B1 | 4/2001 | Shaw | |
| 6,354,760 | B1 | 3/2002 | Boxall et al. | |
| 6,409,423 | B1 | 6/2002 | Li | |
| 6,435,765 | B1 * | 8/2002 | Crane | E01C 7/16 404/31 |
| 6,447,203 | B1 | 9/2002 | Ruiz et al. | |
| 6,592,289 | B1 | 7/2003 | Weander | |
| 6,688,808 | B2 | 2/2004 | Lee | |
| 6,745,532 | B1 | 6/2004 | Vazquez | |
| 6,802,669 | B2 * | 10/2004 | Ianniello | E01F 5/00 404/28 |
| 7,168,884 | B2 * | 1/2007 | Hart | E01C 3/06 404/28 |
| 7,314,334 | B1 | 1/2008 | Bennett et al. | |
| 7,481,031 | B2 | 1/2009 | Boxall et al. | |
| 7,571,581 | B2 | 8/2009 | Covarrubias | |
| 7,637,689 | B2 | 12/2009 | Boxall et al. | |
| 7,716,890 | B2 | 5/2010 | Boxall et al. | |
| 7,784,235 | B2 | 8/2010 | Cretti | |
| 8,381,470 | B2 | 2/2013 | Boxall et al. | |
| 8,511,935 | B1 | 8/2013 | Thomas | |
| 8,627,626 | B2 | 1/2014 | Boxall et al. | |
| 8,844,224 | B2 | 9/2014 | Lindquist | |
| 9,561,557 | B2 | 2/2017 | Anagnostopoulos | |
| 10,280,568 | B2 | 5/2019 | McDonald | |
| 2004/0187431 | A1 | 9/2004 | Boxall et al. | |
| 2005/0220539 | A1 | 10/2005 | Yee | |
| 2006/0177268 | A1 | 8/2006 | Kramer | |
| 2006/0177269 | A1 | 8/2006 | Kramer | |
| 2007/0059096 | A1 | 3/2007 | Boxall et al. | |
| 2010/0242401 | A1 | 9/2010 | Boxall et al. | |
| 2013/0101349 | A1 * | 4/2013 | Wayne | E01C 7/185 404/31 |
| 2013/0209171 | A1 | 8/2013 | Thomas | |
| 2014/0021185 | A1 | 1/2014 | Anagnostopoulos | |
| 2014/0270948 | A1 | 9/2014 | Heady et al. | |
| 2014/0270949 | A1 | 9/2014 | Heady | |
| 2015/0013262 | A1 | 1/2015 | Wilkes et al. | |
| 2015/0110555 | A1 | 4/2015 | Covarrubias Vidal | |
| 2016/0017548 | A1 | 1/2016 | Schenk | |
| 2016/0053442 | A1 * | 2/2016 | Kaiser | C08G 18/837 404/31 |
| 2017/0089373 | A1 | 3/2017 | Schulte | |
| 2018/0320373 | A1 | 11/2018 | Rodden | |
| 2018/0347610 | A1 | 12/2018 | Zuk | |
| 2019/0276987 | A1 | 9/2019 | Rodden et al. | |

FOREIGN PATENT DOCUMENTS

| | | | |
|---|---|---|---|
| ES | 2149103 | A1 | 10/2000 |
| KR | 101520853 | B1 | 5/2015 |
| KR | 20180014651 | A | 2/2018 |
| WO | 2000001890 | A1 | 1/2000 |
| WO | WO 00/01890 | | 1/2000 |
| WO | 2002012630 | A1 | 2/2002 |
| WO | WO 02/12630 | | 2/2002 |
| WO | WO 2008/086577 | | 7/2008 |

OTHER PUBLICATIONS

Double Tapered Basket®, brochure, Sika Corporation, published Sep. 2018 (2 pages).

"PD3 Basket Assembly", product data sheet, PNA™ Construction Technologies , Jan. 2010, 2 pages.

* cited by examiner

METHOD AND APPARATUS FOR TWO-LIFT CONCRETE FLATWORK PLACEMENT

PRIORITY

This patent application claims the benefit of and priority to U.S. Provisional Patent Application No. 62/866,331 filed Jun. 25, 2019, the entire contents of which are incorporated herein by reference.

BACKGROUND

Concrete substrates (such as floors and roadways) typically include a series of separate individually poured or cast-in-place concrete slabs. Construction joints are typically used to join or are formed at and between such separately individually poured adjacent concrete slabs (i.e., adjacent concrete slabs that are poured at different or sequential times). For example, longitudinally extending construction joints are typically used to form joints between the concrete slabs of adjacent lanes of a roadway. Transverse construction joints are also typically used to join the adjacent transverse ends or transverse vertically extending edges of certain adjacent concrete slabs that are separately individually poured (such as concrete slabs in a single lane of a roadway that are poured on sequential days).

The term concrete slab as used herein is meant to include a separately individually poured or cast-in-place concrete slab or a concrete slab formed from a larger concrete slab.

Concrete substrates can also be made up of concrete slabs that are formed from larger concrete slabs that are individually poured or cast-in-place. Such concrete slabs that are formed from such larger concrete slabs are typically made by forming one or more contraction joints in the larger concrete slabs. Contraction joints (which are also sometimes called control joints) are used to control naturally occurring cracking in concrete substrates from stresses caused by concrete shrinkage, thermal contraction, moisture or thermal gradients within the concrete, and/or various external forces on the concrete substrates. Contraction joints are typically formed by vertically cutting the concrete substrates along or at the area of the desired location of the contraction joint. Contraction joints are typically vertically sawed into the concrete and often extend approximately one third of the way through the depth of the concrete. When a larger concrete slab cracks along a contraction joint, the smaller concrete slabs are formed.

Concrete substrates can be made using various known paving processes. One known paving process is a two-lift, wet-on-wet jointed paving process that employs generally cylindrical elongated dowels for contraction joints to facilitate load transfer between adjacent concrete slabs. This known paving process includes: (1) positioning a plurality of round dowel bars at a specified distance above the support base for the concrete substrate; (2) placing a first wet concrete layer on the support base for the concrete substrate (including spreading the first wet concrete layer such that the first wet concrete layer includes a thickness sufficient to cover the cylindrical elongated dowel bars); and (3) placing a second wet concrete layer directly on top of the first concrete layer (including spreading the second concrete layer to cover the first concrete layer with a desired thickness).

In one such known paving process, the desired final concrete slab thickness is 9 inches and the dowel bars are placed 4.5 inches above the support base. The first wet concrete layer is spread to form a 6 inch thickness that covers the cylindrical elongated dowel bars. The second wet concrete layer is spread on the top surface of the first concrete layer to form a 3 inch thickness above the top surface of the first concrete layer. Thus, the 9 inch thick concrete substrate is formed including a 6 inch thick first concrete layer and a 3 inch thick second concrete layer. In this known paving process, the first concrete layer is made thicker than the distance between the support base and the cylindrical elongated dowel bars such that the first concrete layer covers those dowel bars.

Another known two-lift, wet-on-wet jointed paving process includes inserting cylindrical elongated dowel bars downward through the first wet concrete layer. This known process includes: (1) placing a first wet concrete layer on the support base for the concrete substrate (including spreading the first wet concrete layer to form the desired first layer thickness); (2) inserting cylindrical elongated dowel bars through the top surface of the first concrete layer and pushing the cylindrical dowel bars through the first concrete layers to their final location in the first concrete layer; and (3) placing the second wet concrete layer directly on top of the first concrete layer (including spreading the second wet concrete layer to form the desired second layer thickness).

Another known two-lift, wet-on-wet jointed paving process includes inserting cylindrical elongated dowel bars downward through previously placed second and first wet concrete layers. This known process includes: (1) placing a first wet concrete layer on the support base for the concrete substrate (including spreading the first wet concrete layer to form the desired first layer thickness); (2) placing the second wet concrete layer directly on top of the first concrete layer (including spreading the second wet concrete layer to form the desired second layer thickness); and (3) inserting cylindrical elongated dowel bars through the top surface of the second concrete layer and pushing the cylindrical dowel bars through the second and first concrete layers to their final location in the first concrete layer.

While certain known paving methods may be used for two-lift, wet-on-wet jointed concrete substrates, these known methods add additional cost and material to the concrete substrate paving process. Furthermore, these known methods may require specialized equipment for manufacturing two-lift, wet-on-wet jointed concrete substrates.

SUMMARY

Various embodiments of the present disclosure provide a concrete slab load transfer apparatus and methods of manufacturing a concrete substrate using the concrete slab load transfer apparatus.

Various embodiments of the present disclosure provide a method of manufacturing a concrete substrate including: (1) placing a first wet concrete layer on a support base configured to support the concrete substrate; (2) positioning a concrete slab load transfer apparatus on a top surface of the first concrete layer, wherein the top surface of the first concrete layer supports the concrete slab load apparatus; and (3) placing a second wet concrete layer on top of the first concrete layer such that the second concrete layer covers the concrete slab load transfer apparatus.

Additional features and advantages of the present invention are described in, and will be apparent from, the following Detailed Description and the Figures.

DETAILED DESCRIPTION OF EXAMPLE EMBODIMENTS

Figure 1:
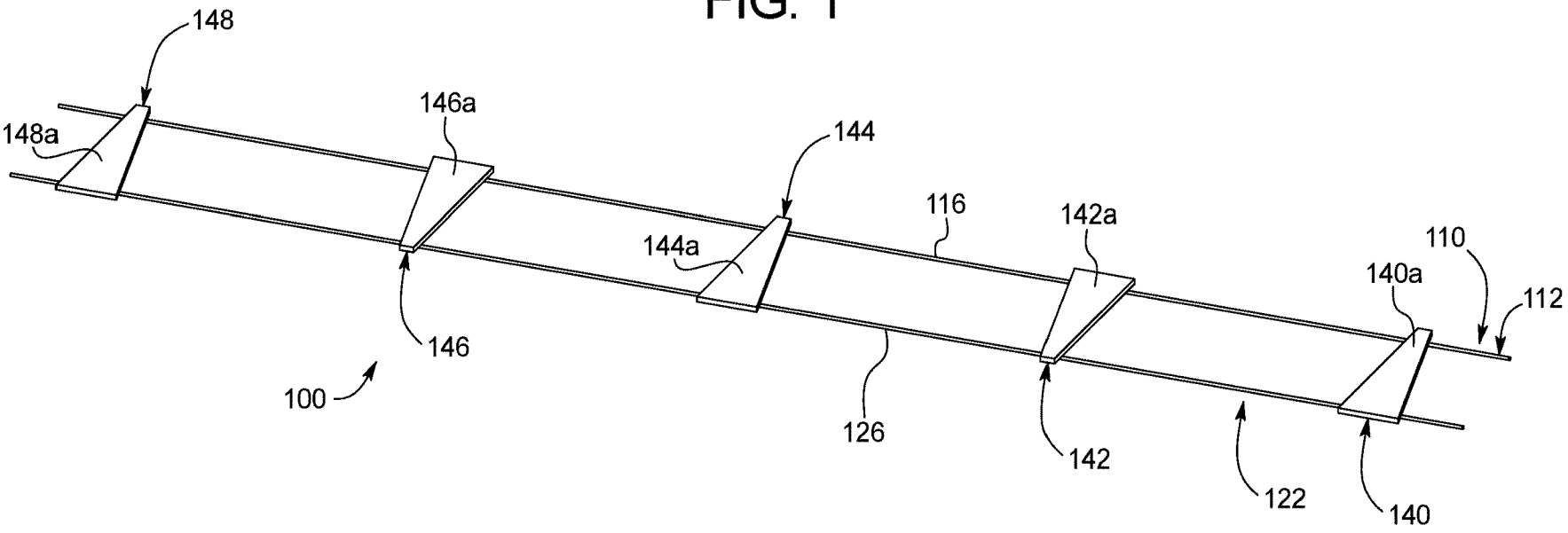
FIG. 1 is a perspective view of an example embodiment of the concrete slab load transfer apparatus of the present disclosure.
Figure 2:
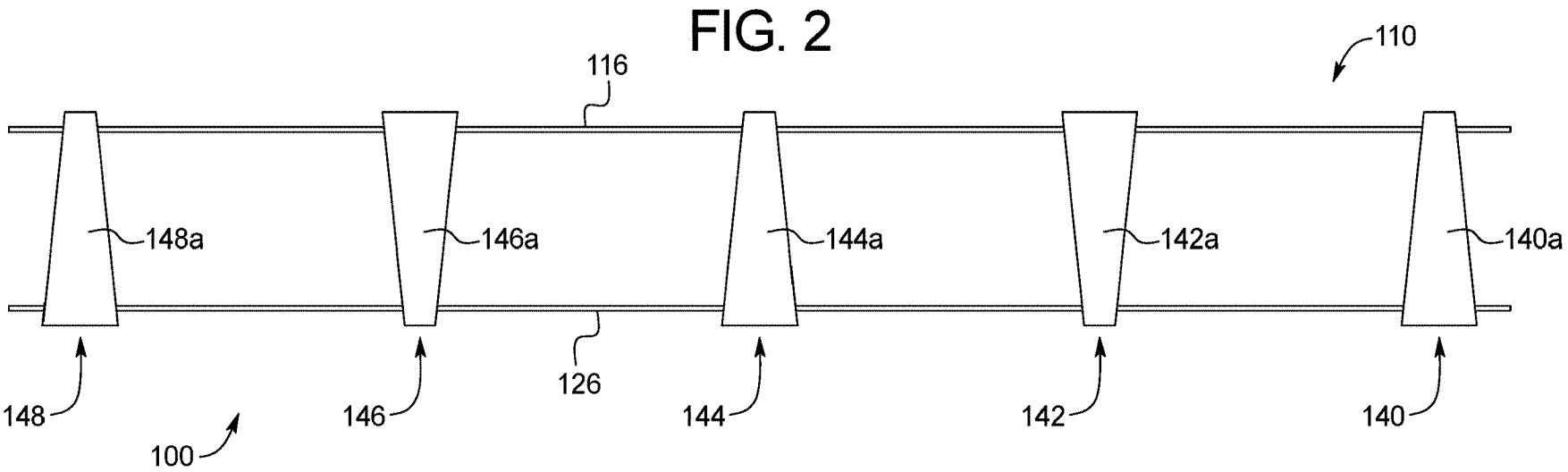
FIG. 2 is a top view of the concrete load transfer apparatus of FIG. 1.

While the features, devices, and apparatus described herein may be embodied in various forms, the drawings show and the specification describe certain exemplary and non-limiting embodiments. Not all of the components shown in the drawings and described in the specification may be required, and certain implementations may include additional, different, or fewer components. Variations in the arrangement and type of the components; the shapes, sizes, and materials of the components; and the manners of connections of the components may be made without departing from the spirit or scope of the claims. Unless otherwise indicated, any directions referred to in the specification reflect the orientations of the components shown in the corresponding drawings and do not limit the scope of the present disclosure. Further, terms that refer to mounting methods, such as mounted, attached, connected, and the like, are not intended to be limited to direct mounting methods but should be interpreted broadly to include indirect and operably mounted, attached, connected and like mounting methods. This specification is intended to be taken as a whole and interpreted in accordance with the principles of the present disclosure and as understood by one of ordinary skill in the art.

Various embodiments of the present disclosure provide a method of manufacturing a concrete substrate and a concrete slab load transfer apparatus used in the manufacture of the concrete substrate. For brevity, the concrete slab load transfer apparatus may sometimes be referred to herein as the load transfer apparatus or as the apparatus. Such abbreviations are not meant to limit the scope of the present disclosure.

Example Load Transfer Apparatus

One example embodiment of the concrete slab load transfer apparatus that may be used in the manufacture of a concrete substrate in accordance with the present disclosure is generally illustrated in FIGS. 1, 2, 3, 4, 5, 6, 7, 8, 9, 10A, 10B, and 10C. This example embodiment of the concrete slab load transfer apparatus of the present disclosure is generally indicated by numeral 100.

In this illustrated example embodiment, this concrete slab load transfer apparatus 100 generally includes: (a) a plurality of metal such as steel planar load transfer dowels 140, 142, 144, 146, and 148; (b) a metal such as a steel basket 110 configured to support the load transfer dowels 140, 142, 144, 146, and 148; (c) a plurality of breakable welds 150, 152, 154, 156, and 158 (best seen in FIG. 3), that temporarily attach the load transfer dowels 140, 142, 144, 146, and 148 to the basket 110; and (d) a plurality of welds and particularly line welds 160, 162, 164, 166, and 168 (best seen in FIG. 3) that attach the load transfer dowels 140, 142, 144, 146, and 148 to the basket 110. The breakable welds 150, 152, 154, 156, and 158 are formed to attach the respective bottom surfaces 140*b*, 142*b*, 144*b*, 146*b*, and 148*b* of the dowels 140, 142, 144, 146, and 148 to the basket 110 such that when the concrete slab load transfer apparatus 100 is positioned at an area where a contraction joint will be formed between two adjacent concrete slabs, the movement of the concrete slabs will cause the narrow ends of the load transfer dowels 140, 142, 144, 146, and 148 to break off of or from the basket 110 and function to provide load transfer between the concrete slabs. In other words, the breakable welds 150, 152, 154, 156, and 158 connect the load transfer dowels 140, 142, 144, 146, and 148 to the basket 110 during shipping and installation of the load transfer apparatus 100. However, following placement of the load transfer apparatus 100 within the concrete slabs, the breakable welds 150, 152, 154, 156, and 158 break free from the basket 110 as the contraction joint opens.

The basket 110 in this illustrated example embodiment includes a first steel leg 112 and a spaced apart second steel leg 122. The first leg 112 includes an elongated steel member 116. Likewise, the second leg 122 includes an elongated steel member 126. In this illustrated example embodiment, the elongated member 116, and the elongated member 126, are both metal rods such as steel rods. It should be appreciated that such members can be made from other suitable materials. It should be appreciated that one or more of the legs can be alternatively formed.

Figure 9:
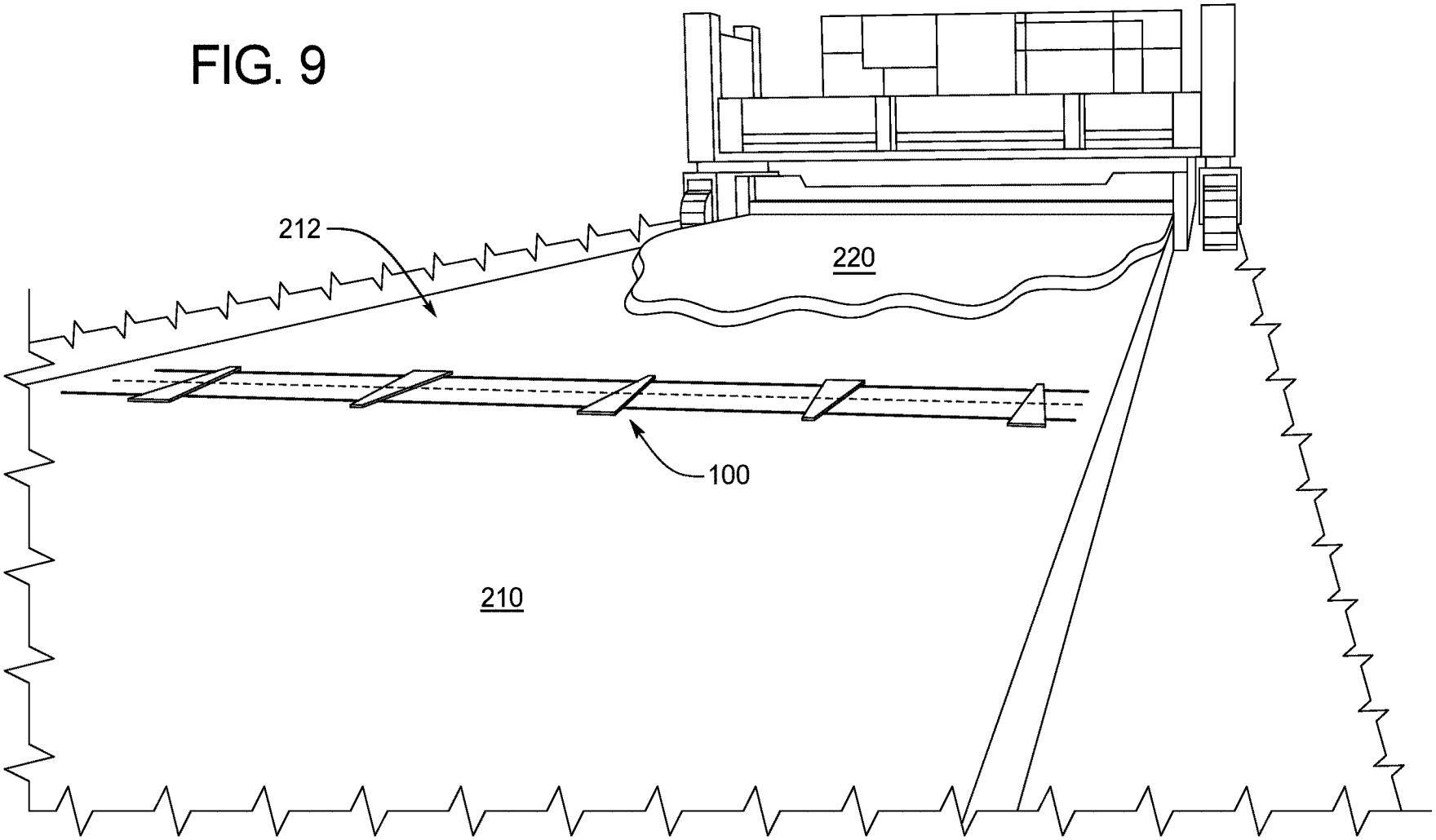
FIG. 9 is a fragmentary perspective view of the concrete slab load transfer apparatus of FIG. 1 positioned on the top surface of a first lift in a two-lift, wet-on-wet jointed roadway, and showing the concrete slab load transfer apparatus particularly positioned at an area where a contraction joint will be formed.

The first and second legs 112 and 122 are configured to co-act to hold and support the plurality of load transfer dowels 140, 142, 144, 146, and 148 at or along an area where a contraction joint will be formed as generally shown in FIG. 9 and further described below.

The load transfer dowels 140, 142, 144, 146, and 148 are partly detachably attached to and supported by the basket 110, and specifically partly detachably attached to and supported by the first leg 112 and the second leg 122 in opposing fashion in this illustrated example embodiment. In the illustrated example, the load transfer dowels 140, 142, 144, 146, and 148 include a wider end and a narrower end that defines a taper of the load transfer dowels. More specifically, in this illustrated example embodiment: (a) the wider end of the load transfer dowel 140 is supported by and line welded at weld 160 to the elongated member 126; (b) the narrower end of the load transfer dowel 140 is supported by and spot welded at breakable weld 150 to the elongated member 116; (c) the narrower end of the load transfer dowel 142 is supported by and spot welded at breakable weld 152 to the elongated member 126; (d) the wider end of the load transfer dowel 142 is supported by and line welded at weld 162 to the elongated member 116; (e) the narrower end of the load transfer dowel 144 is supported by and spot welded at breakable weld 154 to the elongated member 116; (f) the wider end of the load transfer dowel 144 is supported by and line welded at weld 164 to the elongated member 126; (g) the narrower end of the load transfer dowel 146 is supported by and spot welded at breakable weld 156 to the elongated member 126; (h) the wider end of the load transfer dowel 146 is supported by and line welded at weld 166 to the elongated member 116; (i) the narrower end of the load transfer dowel 148 is supported by and spot welded at breakable weld 158 to the elongated member 116; and (j) the wider end of the load transfer dowel 148 is supported by and line welded at weld 168 to the elongated member 126. The load transfer dowels 140, 142, 144, 146, and 148 thus hold the legs 112 and 122 in the desired spaced apart relation until the load transfer dowels 140, 142, 144, 146, and 148 break off (via the breakable welds) from the legs 112 and 122 when in use.

It should be appreciated that the directions of the respective tapers of the load transfer dowels 140, 142, 144, 146, and 148 alternate from one load transfer dowel to the adjacent load transfer dowel. For contraction joints, if the center of the contraction joint ends up positioned somewhat off-center relative to these load transfer dowels 140, 142, 144, 146, and 148, the alternating tapered pattern of load dowels 140, 142, 144, 146, and 148 compensates for this misalignment.

In this illustrated embodiment, each of the load transfer dowels 140, 142, 144, 146, and 148 has a top tapered planar surface (respectively, surfaces 140*a*, 142*a*, 144*a*, 146*a*, and 148*a*) and a bottom tapered planar surface (respectively, surfaces 140*b*, 142*b*, 144*b*, 146*b*, and 148*b*). The top and bottom planar surfaces are substantially parallel to one another in this illustrated example embodiment. In this illustrated example embodiment, the top and bottom surfaces taper from approximately 4 inches (10.16 cm) wide to a narrow end approximately 1 inch (2.54 cm) wide over a length of approximately 12 inches (30.48). It should be appreciated that these sizes may vary in accordance with the present disclosure. Certain advantages provided by and load transfer operation of these tapered load transfer dowels are described in U.S. Pat. Nos. 7,716,890, 7,481,031, and 8,381,470.

It should be appreciated that the other suitable tapered shapes and sizes, and/or other suitable shapes and sizes for the dowels may also be employed in accordance with the present disclosure. In certain such alternative embodiments, the dowels include a double tapered shape having tapers on both ends, and are therefore diamond or somewhat diamond shaped.

It should thus be appreciated from the above and as shown in FIG. 9, that in this illustrated example embodiment of the present disclosure, each concrete slab load transfer apparatus 100 is configured to be used or positioned such that the load transfer dowels 140, 142, 144, 146, and 148 of that apparatus 100 are positioned for load transfer at an area where a contraction joint will be formed between adjacent concrete slabs. As such, the slab load transfer apparatus 100 functions to connect and transfer loads between the adjacent concrete slabs. FIG. 9 illustrates the general location where an exemplary contraction joint will be formed as represented by the dashed line transversely spanning the concrete substrate.

It should be appreciated that in this example embodiment, no other members or components connect the two legs 112 and 122 besides the breakable welds and the line welds formed on the respective bottom planar surfaces of the load transfer dowels. In other words, in various embodiments of the present disclosure the two legs 112 and 122 are only connected by the load transfer dowels 140, 142, 144, 146, and 148, the welds including the breakable welds 150, 152, 154, 156, and 158, and the line welds 160, 162, 164, 166, and 168. As a result, the concrete slab load transfer apparatus 100 may be positioned or otherwise placed directly on the top surface 212 of the first lift layer 210 of the concrete substrate 200.

In other embodiments of the present disclosure, suitable clips such as suitable plastic clips are employed to at least partially attach the two legs 112 and 122 to the load transfer dowels 140, 142, 144, 146, and 148.

In the illustrated embodiment, (a) the load transfer dowels are steel; and (b) the components of the basket are steel. It should be appreciated that one or more of these components can be made from other suitable materials in accordance with the present disclosure.

It should also be appreciated that one or more of: (a) the plurality of load transfer dowels; and/or (b) the basket can be made in other suitable sizes, shapes, and configurations in accordance with the present disclosure.

It should also be appreciated that the quantity of load transfer dowels may vary in accordance with the present disclosure.

Example Method of Manufacture of a Concrete Substrate

Referring now to FIGS. 9, 10A, 10B, and 10C, one example embodiment of a method of manufacturing a concrete substrate 200 (such as for a street, road, or floor) using the concrete slab load transfer apparatus 100 of the present disclosure is generally shown. More specifically, the concrete slab load transfer apparatus 100 is employed in a two-lift, wet-on-wet jointed paving process for forming a concrete substrate. In the illustrated example embodiment, the concrete slab load apparatus 100 is configured with a desired quantity of load transfer dowels. The load transfer dowels are spaced as necessary such that the load transfer apparatus 100 spans a desired dimension (e.g., width) of the concrete substrate. In the illustrated example, the load transfer dowels 140, 142, 144, 146, and 148 are suitably connected to the basket 110 with welds 150, 152, 154, 156, 158, 160, 162, 164, 166, and 168 (e.g., spot welds, line welds, and other such welds) as described above.

In one example embodiment, the method of manufacturing the concrete substrate 200 includes: (a) placing a first wet lift layer 210 (e.g., first concrete layer) on a support base that will support the concrete substrate 200; (b) positioning the concrete slab load transfer apparatus 100 on a top surface 212 of the first wet lift layer 210; and (c) placing a second wet lift layer 220 (e.g., second concrete layer) on top of the first lift layer 210. In the illustrated embodiment, the top surface 212 of the first concrete layer 210 supports the concrete slab load transfer apparatus 100. As such, positioning the concrete slab load transfer apparatus 100 may include placing the elongated members 116 and 126 and/or the load transfer dowels 140, 142, 144, 146, and 148 in direct contact with the top surface 212 of the first concrete layer 210. Furthermore, placing the second lift layer 220 on top of the first lift layer 210 covers or otherwise encloses the load transfer apparatus 100 within the concrete substrate 200.

In various such embodiments, the method includes determining a desired total thickness for the concrete substrate prior to starting the paving process. In such embodiments, the desired total thickness includes a first lift thickness and a second lift thickness.

Figure 10A:
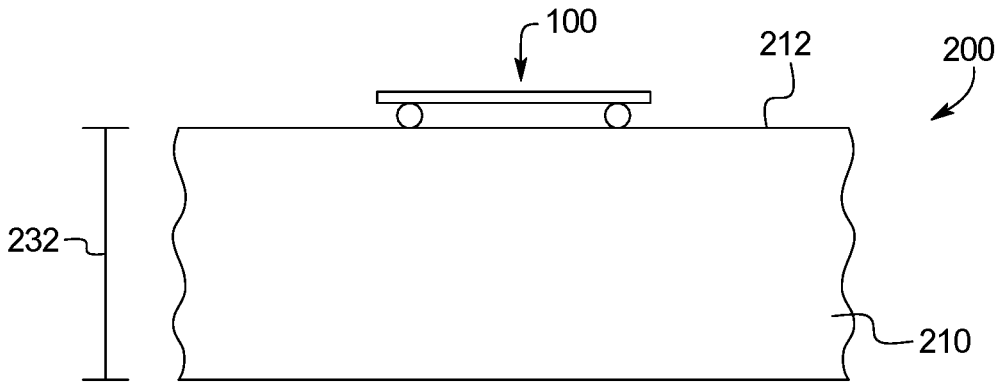
FIG. 10A is a fragmentary side view of the concrete slab load transfer apparatus of FIG. 1 positioned on the surface of the first lift layer in a two-lift, wet-on-wet jointed concrete substrate.
Figure 10B:
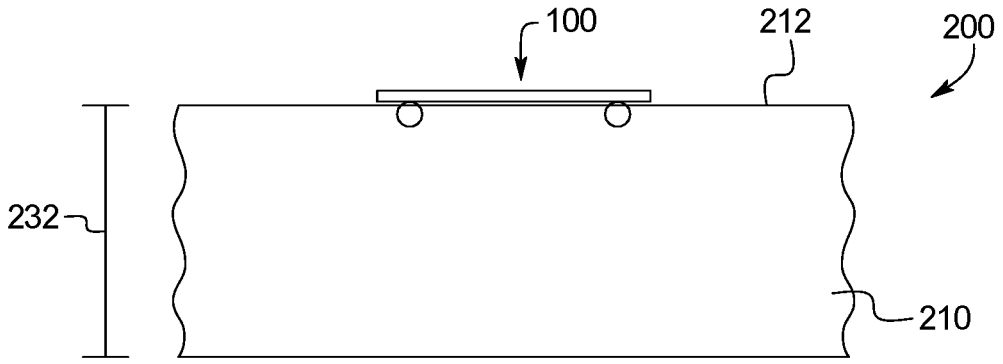
FIG. 10B is a fragmentary side view of the concrete slab load transfer apparatus of FIG. 1 seated on the first lift layer in a two-lift, wet-on-wet jointed concrete substrate.
Figure 10C:
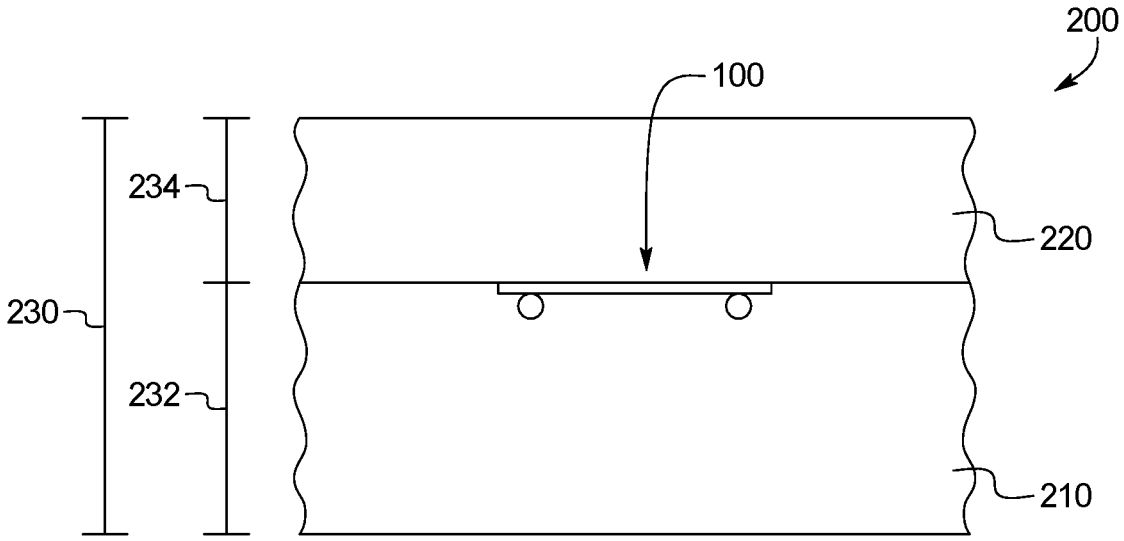
FIG. 10C is a fragmentary side view of the concrete slab load transfer apparatus of FIG. 1 positioned between the first lift layer and the second lift layer in a two-lift, wet-on-wet jointed concrete substrate.

For example, the illustrated example method includes determining a desired total thickness 230 for the concrete substrate 200 prior to starting the concrete substrate manufacture process. The desired total thickness 230 includes a first lift thickness 232 of first lift layer 210 and a second lift thickness 234 of second lift layer 220, as generally illustrated in FIGS. 10A, 10B, and 10C. In this example, the concrete substrate 200 configured with an 8 inch (20.32 cm) desired total thickness 230 includes a 4 inch (10.16 cm) first lift thickness 232 and a 4 inch (01.16 cm) second lift thickness 234. It should be appreciated that the first and second lift layers 210 and 220 can be formed with other suitable thicknesses.

In various embodiments, the desired total thickness 230 includes the first lift thickness 232 approximately equal to the second lift thickness 234. In other various embodiments, the desired total thickness 230 includes the first lift thickness 232 greater than the second lift thickness 234. In other various embodiments, the desired total thickness 230 includes the first lift thickness 232 that is less than the second lift thickness 234.

In various embodiments, the illustrated example method includes placing the first lift layer 210 on the support base prepared for the concrete substrate 200. The first lift layer 210 of concrete is poured or otherwise dispensed from a bulk concrete supply (such as a concrete supply truck) along the base. A sufficient amount of concrete is dispensed from the bulk concrete supply to form the first lift layer 210 including the first lift thickness 232.

In various embodiments, placing the first lift layer 210 further includes spreading the first lift layer 210 to shape and form the first lift layer 210. Shaping and forming the first lift layer may include forming the first lift layer thickness 232 of the first lift layer 210. In various embodiments, paving equipment such as a spreader, a roller, a compactor, and/or other suitable equipment may be used to place and spread the first lift layer 210. As such, the paving equipment spreads the first lift layer 210 to form a concrete layer having a uniform first lift layer thickness 232. In various embodiments, spreading the first lift layer 210 removes (e.g., strikes off) excess concrete that may have been placed on the base or support surface.

Following placement of the first lift layer 210, a concrete slab load transfer apparatus 100 is positioned at a desired location on the top surface 212 of the first lift layer 210. In various embodiments, the concrete slab load transfer apparatus 100 is positioned at an area where a contraction joint will be formed in the concrete substrate 200. In the illustrated embodiment, the load transfer apparatus 100 includes the plurality of load transfer dowels 140, 142, 144, 146, and 148 connected to the legs 112 and 122 of the basket 110. In various embodiments, the legs 112 and 122 only include elongated members 116 and 126 that are connected to the load transfer dowels as described above. Thus, when the load transfer apparatus 100 is positioned on the first lift layer 210, the elongated members 116 and 126 and/or the load transfer dowels 140, 142, 144, 146, and 148 are adjacent to the top surface 212 of the first lift layer 210.

In various embodiments, the load transfer dowels 140, 142, 144, 146, and 148 are only connected to and supported by the elongated members 116 and 126 of the legs 112 and 122. As such, the concrete slab load transfer apparatus 100 includes less material because the basket 110 of the load transfer apparatus 100 does not include a side support frame and/or vertical riser to support and elevate the load transfer dowels and elongated members. Such material reduction in the load transfer apparatus 100 provides a cost savings in the method of concrete substrate manufacture of the present disclosure.

In various embodiments, after the spreading of the first lift layer 210, the concrete slab load transfer apparatus 100 is positioned at the desired location on the top surface 212 of the first lift layer 210. As a result, the top surface 212 of the first lift layer 210 supports or otherwise holds the concrete slab load apparatus 100. As best illustrated in FIG. 10B, the example method includes seating the concrete slab load transfer apparatus 100 in the first lift layer 210. In various embodiments, the concrete slab load transfer apparatus 100 may be at least partially held in place by the first lift layer 210 such that the load transfer apparatus 100 remains at the desired location during the manufacture of the concrete substrate 200. For example, the concrete slab load transfer apparatus 100 may be in direct contact with the top surface 212 of the first lift layer 210. That is, the elongated members 116 and 126 and/or the load transfer dowels 140, 142, 144, 146, and 148 may be at least partially seated or otherwise set into the top surface 212 of the first lift layer 210. Thus, the load transfer apparatus 100 remains positioned at the desired location on top of the first lift layer 210.

In various embodiments, the concrete slab load transfer apparatus 100 may be held by or otherwise fastened to the top surface 212 of the first lift layer 210 by one or more fasteners. In such embodiments, a plurality of stakes or other such fasteners (not shown) may be used to hold the load transfer apparatus 100 to the first lift layer 210. The stakes or other such fasteners position the load transfer apparatus 100 at the desired location on the first lift layer 210.

Once the concrete slab load transfer apparatus 100 is positioned on the first lift layer 210, the method includes placing the second lift layer 220 on the top surface 212 of the first lift layer 210. In various embodiments, the second lift layer 220 is placed directly over the concrete slab load transfer apparatus 100. The second lift layer 220 covers the top surface 212 of the first lift layer 210. Thus, the second lift layer 220, and the underlying first lift layer 210, enclose the load transfer apparatus 100 within the concrete substrate 200. In various embodiments, the concrete slab load transfer apparatus 100 is suspended within the first lift layer 210 and/or the second lift layer 220 of the concrete substrate 200.

In various embodiments, spreading the first lift layer 210 and/or the second lift layer 220 includes rolling, and/or compacting the concrete layers. As such, the concrete slab load transfer apparatus 100 may be placed on the top surface 212 of the first lift layer 210 prior to spreading, rolling, and/or compacting the second lift layer 220. In such embodiments, spreading, rolling, and/or compacting the first lift layer 210 helps to seat or otherwise hold the concrete slab load transfer apparatus 100 at the desired position in the first lift layer 210 prior to placing the second lift layer 220.

In various embodiments, prior to placing the concrete slab load transfer apparatus 100, the first lift layer 210 may be partially spread, rolled, and/or compacted. The load transfer apparatus 100 is then positioned at the desired location on the top surface 212 of first lift layer 210. Once the load transfer apparatus 100 is positioned, the spreading, rolling and/or compacting operations are completed. In various embodiments, the spreading rolling, and/or compacting operations are completed on the first lift layer 210 prior to placing the second lift layer to help seat or otherwise hold the load transfer apparatus 100 at the desired position in the first lift layer 210.

For example, eight cycles of the spreading, rolling, and/or compacting operations may be performed on the first lift layer 210 before positioning the concrete slab load transfer apparatus 100. The load transfer apparatus 100 is then positioned on the top surface 212 of the first lift layer 210. Two or more additional cycles of the spreading, rolling, and/or compacting operations are performed on the first lift layer 210 including the load transfer apparatus 100. The second lift layer 220 is then placed on top of the first lift layer 210 and the load transfer apparatus 100 to complete the concrete substrate 200. While a total of ten spreading, rolling and/or compacting operations are provided on the first lift layer 210 in the above example, it should be appreciated that the spreading, rolling, and/or compacting operations for the first and second lift layers 210 and 220 may be performed an alternative quantity of times.

Figure 3:
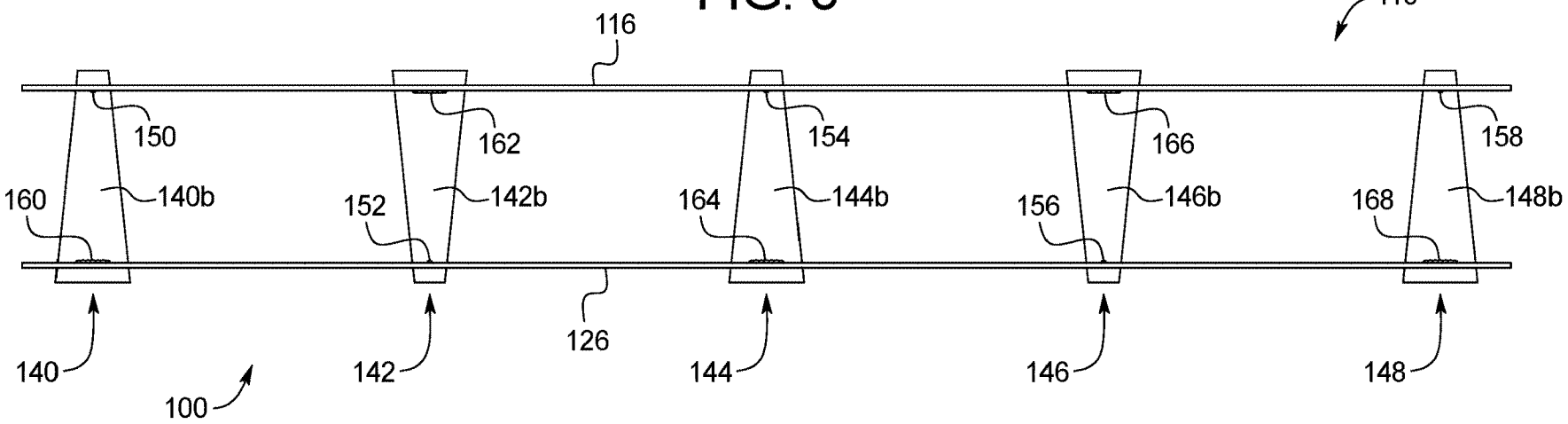
FIG. 3 is a bottom view of the concrete load transfer apparatus of FIG.
Figure 4:
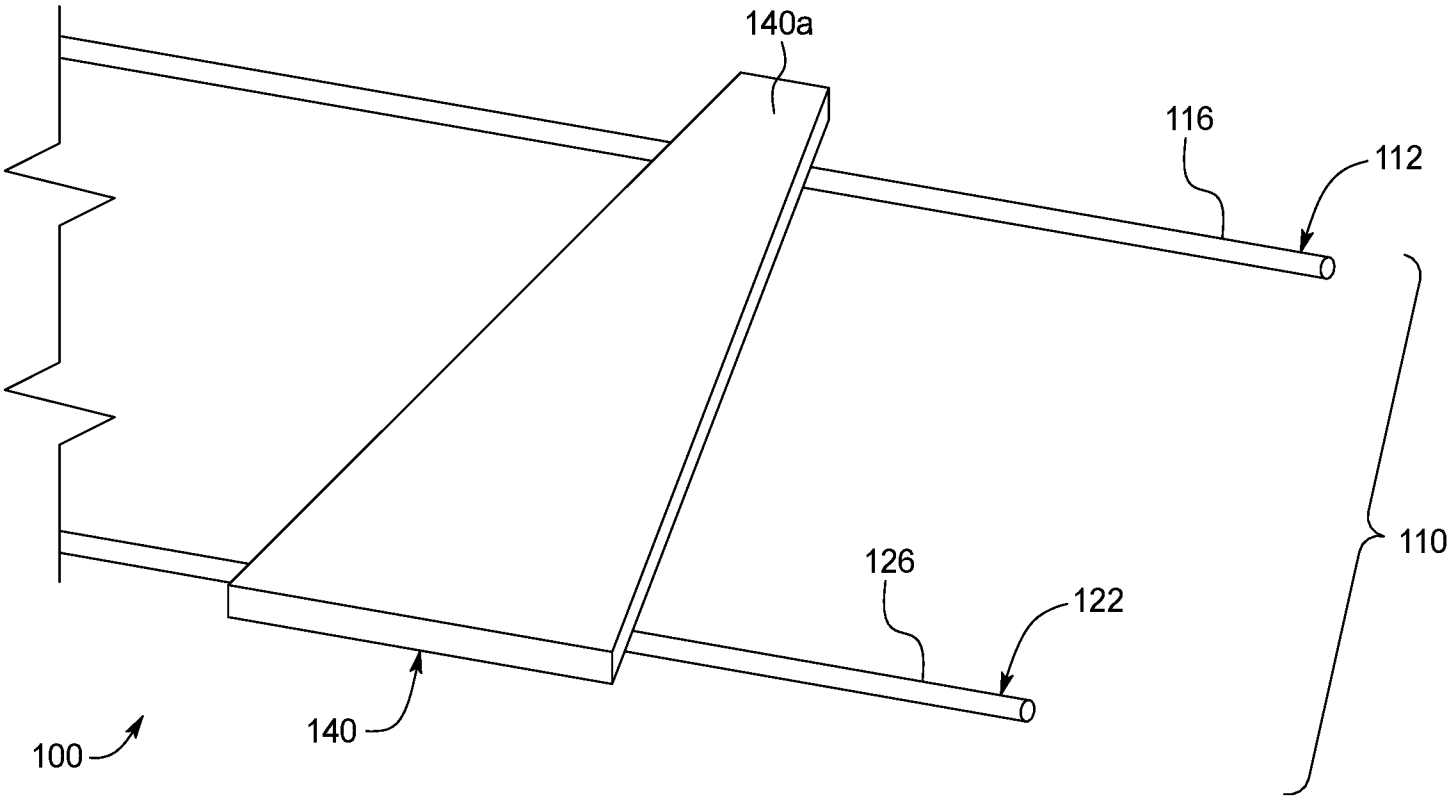
FIG. 4 is an enlarged fragmentary perspective view of one of the load transfer dowels and part of the basket of the concrete slab load transfer apparatus of FIG. 1.
Figure 5:
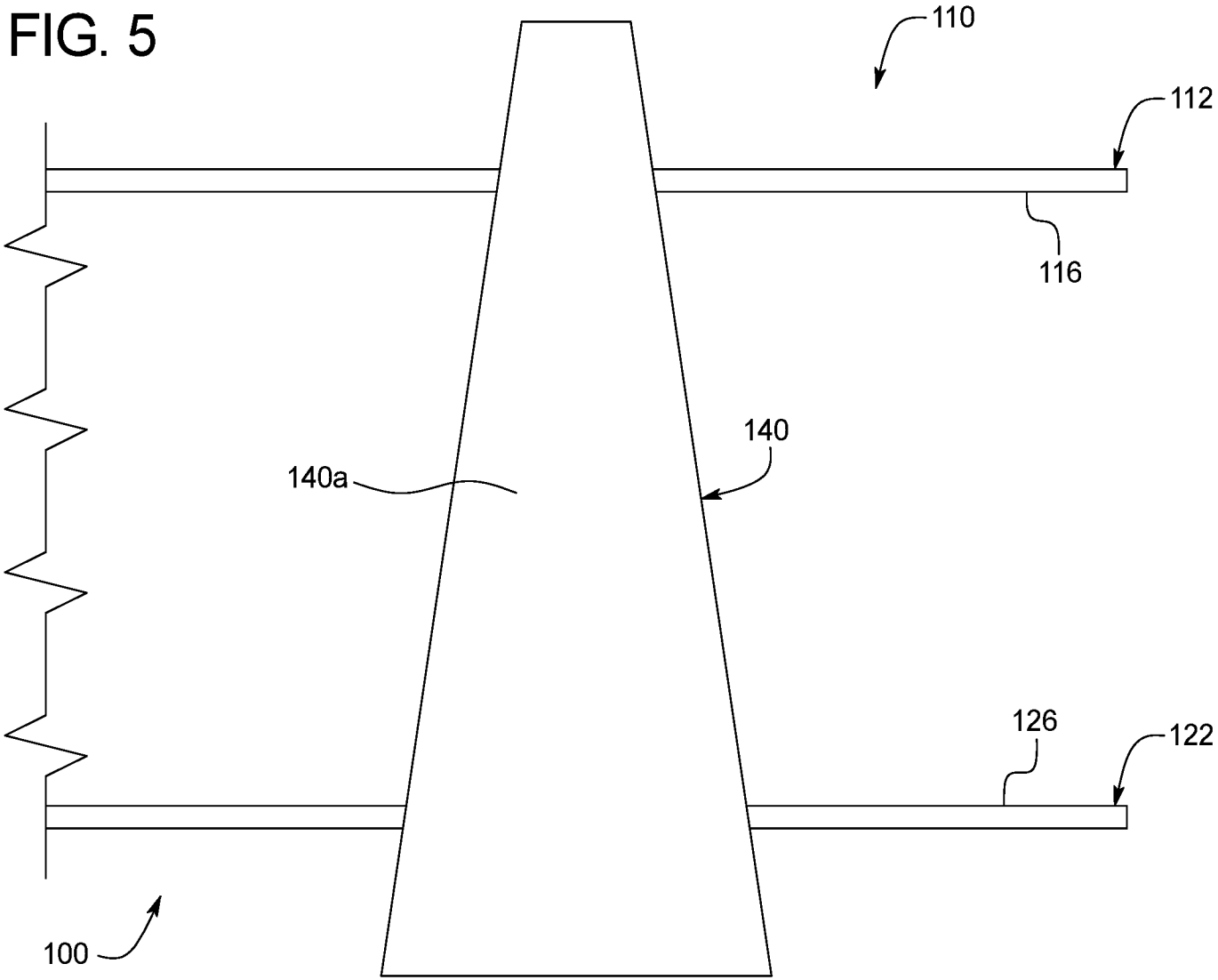
FIG. 5 is an enlarged fragmentary top view of one of the load transfer dowels and part of the basket of the concrete slab load transfer apparatus of FIG. 1.
Figure 6:
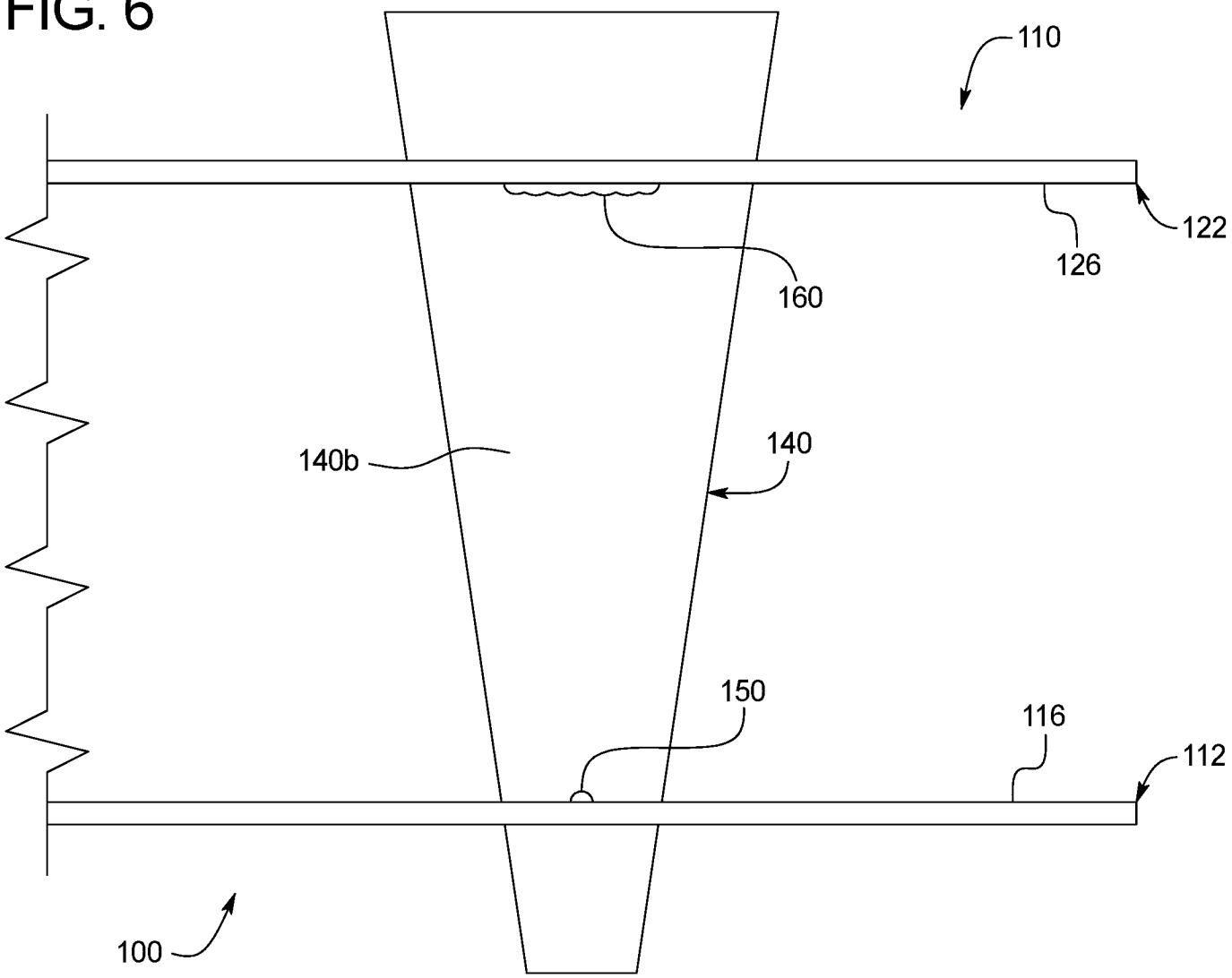
FIG. 6 is an enlarged fragmentary bottom view of one of the load transfer dowels and part of the basket of the concrete slab load transfer apparatus of FIG. 1.
Figure 7:
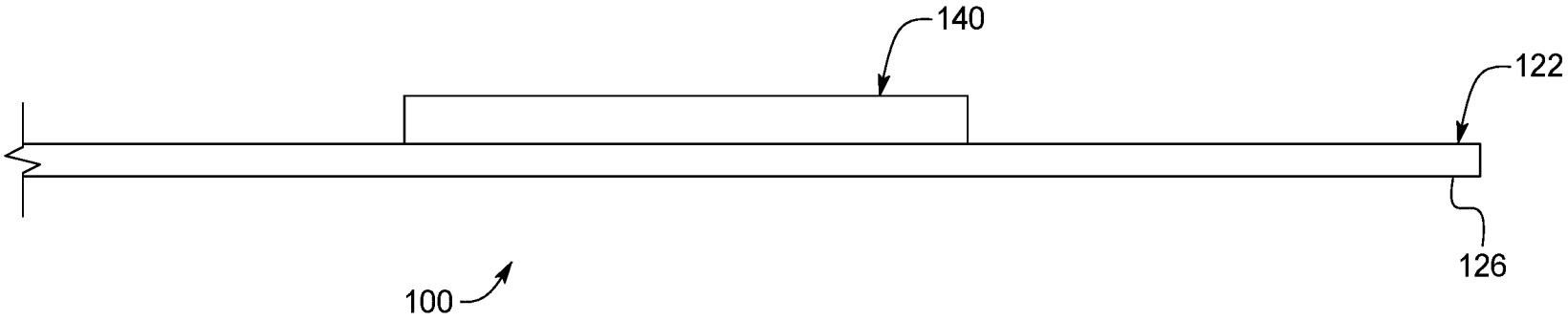
FIG. 7 is an enlarged fragmentary side view of one of the load transfer dowels and the basket of the concrete slab load transfer apparatus of FIG. 1.
Figure 8:
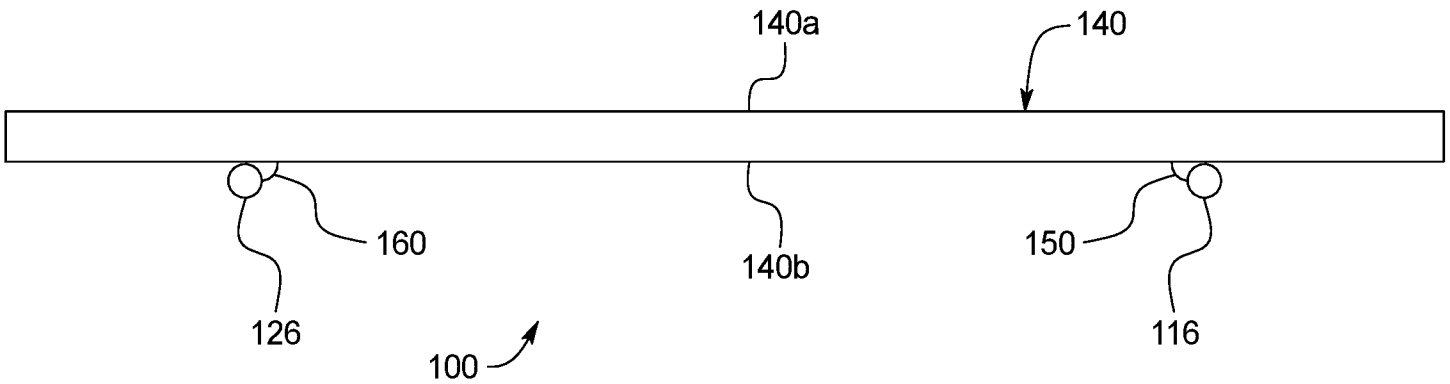
FIG. 8 is an enlarged end view of one of the load transfer dowels and the basket of the concrete slab load transfer apparatus of FIG. 1.

It should be appreciated that in various embodiments, the illustrated example method includes using breakable spot welds and the line welds between the elongated members 116 and 126 of the legs 112 and 122 and the load transfer dowels 140, 142, 144, 146, and 148 (as best seen in FIG. 3) to help transfer loads between adjacent concrete slabs of the concrete substrate 200. As discussed above, these welds attach the elongated members 116 and 126 and the respective bottom surfaces 140*b*, 142*b*, 144*b*, 146*b* and 148*b* of the load transfer dowels 140, 142, 144, 146, and 148. The breakable spot welds 150, 152, 154, 156, and 158 are configured to be broken during use of the load transfer apparatus 100. More specifically, the breakable spot welds 150, 152, 154, 156, and 158, and the line welds 160, 162, 164, 166, and 168 hold the connections between the load transfer dowels 140, 142, 144, 146, and 148 and the elongated members 116 and 126 during placement of the load transfer apparatus 100 at the desired location on the top surface 212 of the first lift layer 210. The breakable spot welds 150, 152, 154, 156, and 158 and the line welds 160, 162, 164, 166, and 168 further hold the connections between the load transfer dowels 140, 142, 144, 146, and 148 during placement of the second lift layer 220. Once the concrete substrate 200 is finished, the breakable spot welds 150, 152, 154, 156, and 158 are configured to break when adjacent concrete slabs cause the load transfer dowels 140, 142, 144, 146, and 148 to move. In other words, while the spot welds 150, 152, 154, 156, and 158 are strong enough to hold their connections during storage, transport, and installation of the load transfer apparatus 100, the spot welds 150, 152, 154, 156, and 158 are configured to fail in the concrete contraction joint during movement of adjacent concrete slabs defined in the concrete substrate 200.

It should also be appreciated from the above that the apparatus of various embodiments of the present disclosure include load transfer dowels and legs that have a relatively short height. This facilitates ease of manufacture, ease of storage and shipping, ease of placement on the first concrete layer, and ease of seating of the legs into the first concrete layer.

Various changes and modifications to the above-described embodiments described herein will be apparent to those skilled in the art. These changes and modifications can be made without departing from the spirit and scope of this present subject matter and without diminishing its intended advantages.

The claims are as follows:

1. A method of manufacturing a concrete substrate, the method comprising:

placing a first concrete layer on a support base configured to support the concrete substrate;

positioning a concrete slab load transfer apparatus on a top surface of the first concrete layer such that the top surface of the first concrete layer supports the concrete slab load transfer apparatus, wherein the concrete slab load transfer apparatus includes a plurality of planar load transfer dowels attached to an elongated basket; and placing a second concrete layer on the top surface of the first concrete layer such that the second concrete layer covers the concrete slab load transfer apparatus.

2. The method of claim 1, wherein positioning the concrete slab load transfer apparatus includes positioning the concrete slab load transfer apparatus at an area where a contraction joint will be formed in the concrete substrate.

3. The method of claim 1, which includes fastening the concrete slab load transfer apparatus to the top surface of the first concrete layer prior to placing the second concrete layer.

4. The method of claim 1, wherein positioning the concrete slab load transfer apparatus includes seating the basket of the concrete slab load transfer apparatus in the first concrete layer.

5. The method of claim 1, wherein positioning the concrete slab load transfer apparatus includes seating the basket but not the planar load transfer dowels of the concrete slab load transfer apparatus in the first concrete layer.

6. The method of claim 1, wherein the basket and load transfer dowels are metal.

7. The method of claim 1, wherein the load transfer dowels are attached to the basket by a plurality of welds.

8. The method of claim 1, wherein the basket includes an elongated first leg and an elongated second leg, wherein each of the load transfer dowels is detachably attached to one of the first leg and the second leg.

9. The method of claim 1, wherein the basket includes an elongated first leg and an elongated second leg, wherein each of the load transfer dowels is alternately detachably attached to one of the first leg and the second leg.

10. The method of claim 1, wherein the basket and load transfer dowels are steel, wherein the basket includes an elongated steel first member and a spaced apart elongated steel second member, wherein the load transfer dowels are planar tapered steel plates, wherein the load transfer dowels are attached to the elongated steel first member and the elongated steel second member by a plurality of line welds and a plurality of breakable welds that temporarily attach the load transfer dowels to the basket.

11. The method of claim 1, which includes rolling and compacting the first concrete layer prior to placing the second concrete layer.

12. The method of claim 11, wherein the concrete slab load transfer apparatus is positioned on the top surface of the first concrete layer after rolling and compacting the first concrete layer.

13. The method of claim 12, which includes a second rolling and compacting of the first concrete layer after the concrete slab load transfer apparatus is positioned on the top surface of the first concrete layer.

14. The method of claim 13, wherein the second rolling and compacting the first concrete layer seats the concrete slab load transfer apparatus partially in the first concrete layer.

15. The method of claim 13, wherein the second rolling and compacting the first concrete layer seats the basket of the concrete slab load transfer apparatus in the first concrete layer.

16. The method of claim 13, wherein the second rolling and compacting the first concrete layer seats the basket but not the load transfer dowels of the concrete slab load transfer apparatus in the first concrete layer.

17. The method of claim 1, wherein the load transfer dowels are attached to the basket by a plurality of line welds and a plurality of breakable welds that temporarily attach the load transfer dowels to the basket.

18. The method of claim 17, wherein the basket includes an elongated first member and a spaced apart elongated second member.

* * * * *